US010537160B1

(12) United States Patent
Busiashvili

(10) Patent No.: US 10,537,160 B1
(45) Date of Patent: Jan. 21, 2020

(54) JEWELRY DEVICE

(71) Applicant: Rachel Adin LLC, Los Angeles, CA (US)

(72) Inventor: Jessica Rachel Busiashvili, Beverly Hills, CA (US)

(73) Assignee: Rachel Adin LLC, Los Angeles, CA (US)

( * ) Notice: Subject to any disclaimer, the term of this patent is extended or adjusted under 35 U.S.C. 154(b) by 0 days.

(21) Appl. No.: 16/137,713

(22) Filed: Sep. 21, 2018

(51) Int. Cl.
*A44C 17/02* (2006.01)
*A44C 11/00* (2006.01)
*A44C 5/10* (2006.01)

(52) U.S. Cl.
CPC ..... *A44C 17/02* (2013.01); *A44C 5/102* (2013.01)

(58) Field of Classification Search
CPC ..... A44C 5/02; A44C 5/102; A44C 5/105; A44C 5/107; A44C 5/10; A44C 15/0025; A44C 7/00; A44C 11/00; A44C 11/007; A44C 13/00; A44C 25/001
USPC ..... 63/3, 9, 28, 38, 39, 26, 4; D11/12, 16; 59/82, 84, 90–92
See application file for complete search history.

(56) References Cited

U.S. PATENT DOCUMENTS

| | | | | |
|---|---|---|---|---|
| D317,139 | S * | 5/1991 | Chia | D11/93 |
| 6,220,010 | B1 * | 4/2001 | Gomez | A44C 11/002 59/2 |
| 7,007,508 | B1 | 3/2006 | Valentini | |
| 7,296,438 | B2 | 11/2007 | Kolb | |
| 7,546,749 | B1 | 6/2009 | Biren | |
| D620,385 | S * | 7/2010 | Javaheri | D11/43 |
| 9,273,707 | B2 | 3/2016 | Lee | |
| 2008/0104995 | A1 | 5/2008 | Butler | |

FOREIGN PATENT DOCUMENTS

| | | | | |
|---|---|---|---|---|
| CN | 103607924 A | | 2/2014 | |
| FR | 1590205 A | * | 4/1970 | A44C 5/105 |

* cited by examiner

*Primary Examiner* — Jack W Lavinder
(74) *Attorney, Agent, or Firm* — Banner & Witcoff, Ltd.

(57) ABSTRACT

An article of chained jewelry may include a pod unit fitting into the body of each pod unit, both stacking up vertically and horizontally. Each pod unit is provided be so that the body of each pod unit is designed to have a protrusion extending out on one side, and an opening on the opposite side of body along an axis. In operation, when one pod unit is place next to another, the protrusion extending from the body mates or connects into the opening of the adjacent pod unit, to form a chain of pod units.

20 Claims, 9 Drawing Sheets

JEWELRY DEVICE

FIELD OF INVENTION

The field of invention relates generally to jewelry, and more specifically, to an article of chain jewelry adapted to be worn around a portion of a human body.

BACKGROUND

Jewelry is generally worn to adorn the wearer. The annual global sales in the jewelry market are in the billions of dollars. The Gemological Institute of America has estimated that approximately 25% to 35% of diamonds have some degree of fluorescence. The perceived negative value of less bright stones has meant that jewelers have sought to hide this feature from, or deemphasize it, to customers. Stones with less brilliant grades sell at significant discounts in the trade.

SUMMARY

Aspects of the present disclosure relate to an article of chain jewelry adapted to be worn around a portion of a human body. In one configuration, the article of jewelry may include a plurality of interlocking pods provided in an opposing-stacked arrangement in which the pods have a longitudinal axis; wherein at least one pod includes a light tunnel generally disposed along the longitudinal axis within opposing ends of the light tunnel is configured to receive an object therein.

In another aspect of an article of jewelry, each of pods has a body including an opening into the light tunnel and an opposing peg extending from the body. In yet another aspect of an article of jewelry, the peg of an adjacent pod matingly interlocks within the opening of the adjacent pod. In yet another aspect of an article of jewelry, the interlocked pods are enabled to move with respect to each along an axis created by the peg. In another aspect of an article of jewelry, each pod includes a bezel setting for mounting the object therein.

In one configuration, the article of jewelry may include a pod unit fitting into the body of each pod unit, both stacking up vertically and horizontally. Each pod unit is provided be so that the body of each pod unit is designed to have a protrusion extending out on one side, and a complementary opening on the opposite side of the body along an axis. In operation, when one pod unit is place next to another, the protrusion extending from the body mates or connects into the opening of the adjacent pod unit, to form a chain of pod units. The stability of each unit rests onto another.

In one configuration, an article of jewelry is adapted to be worn around a portion of a human body. The a plurality of interlocking double bezel pods provided in an opposing-stacked arrangement in which the pods have a longitudinal axis; wherein each of the pods includes a light-tube generally disposed along the longitudinal axis connecting the opposing bezels of the pod.

BRIEF DESCRIPTION OF THE DRAWINGS

The present disclosure is pointed out with particularity in the appended claims. Features of the disclosure will become more apparent upon a review of this disclosure in its entirety, including the drawing figures provided herewith. Some features herein are illustrated by way of example, and not by way of limitation, in the figures of the accompanying drawings, in which like reference numerals refer to similar elements, and wherein:

DETAILED DESCRIPTION

Figure 1:
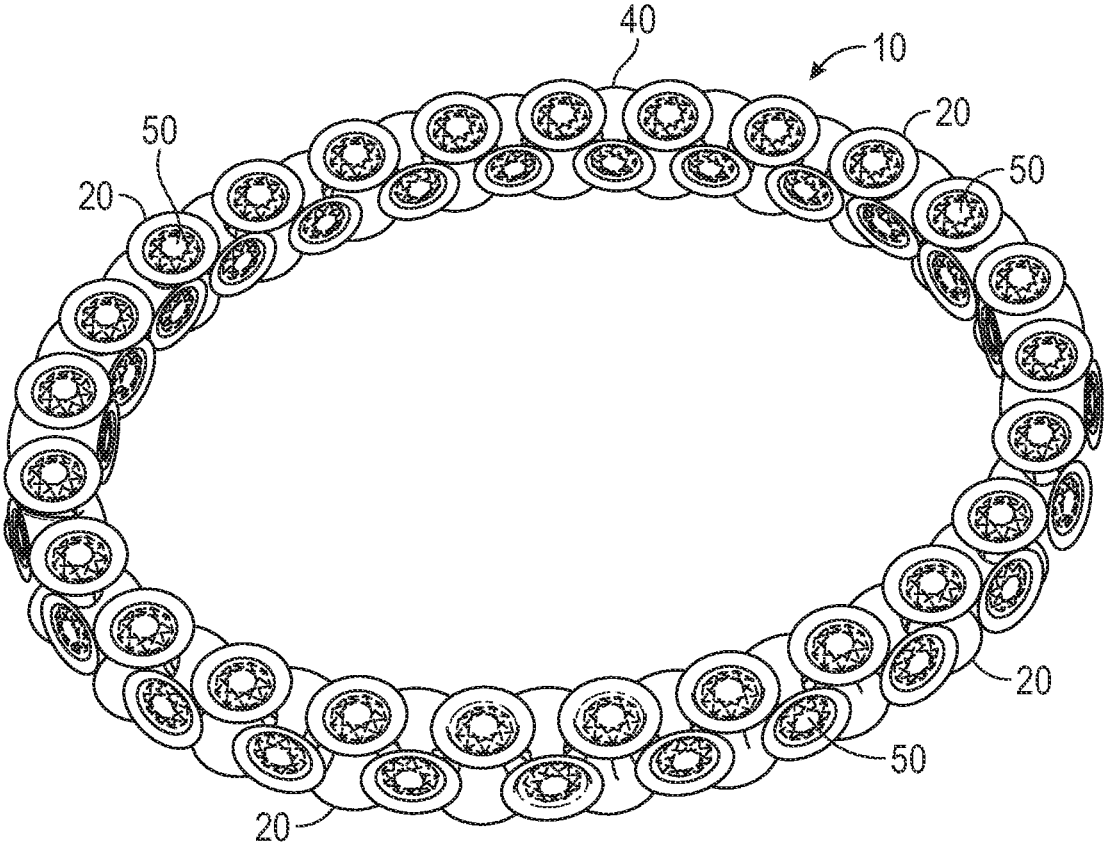
FIG. 1 illustrates a perspective view of a jewelry device in accordance with the various teachings of the present disclosure.
Figure 2:
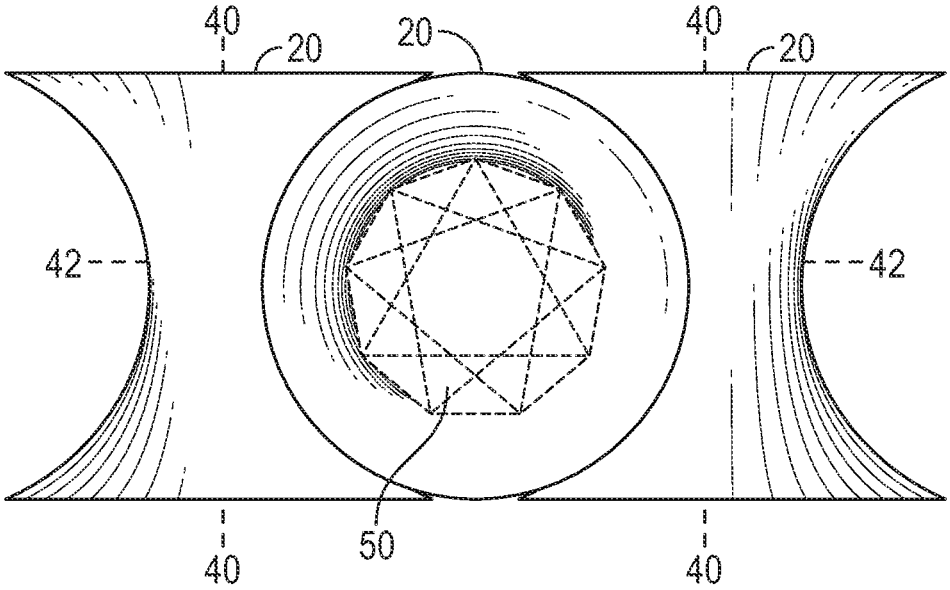
FIG. 2 illustrates a side view of portion of the jewelry device in accordance with the various teachings of the present disclosure
Figure 3:
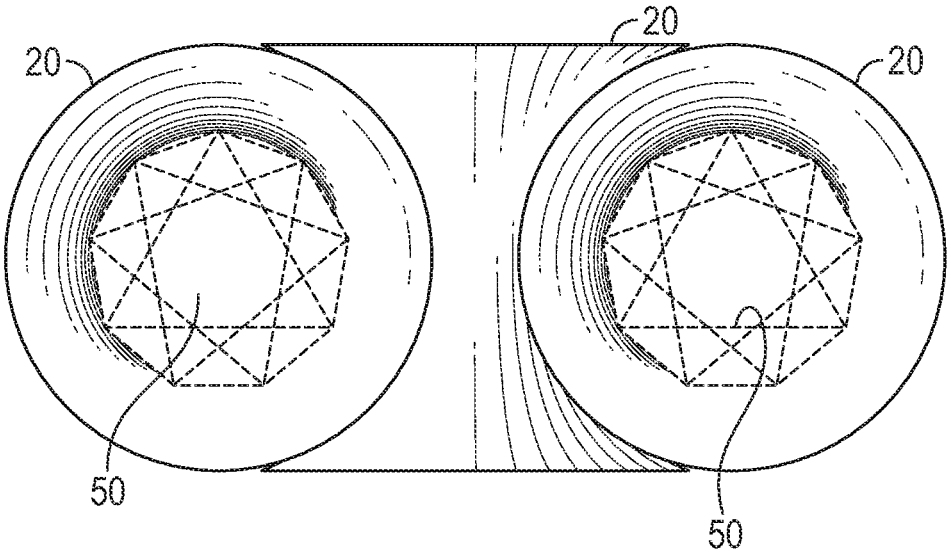
FIG. 3 illustrates a top view of the portion of the jewelry device shown in FIG. 2; the bottom view being a mirror image thereof.
Figure 4:
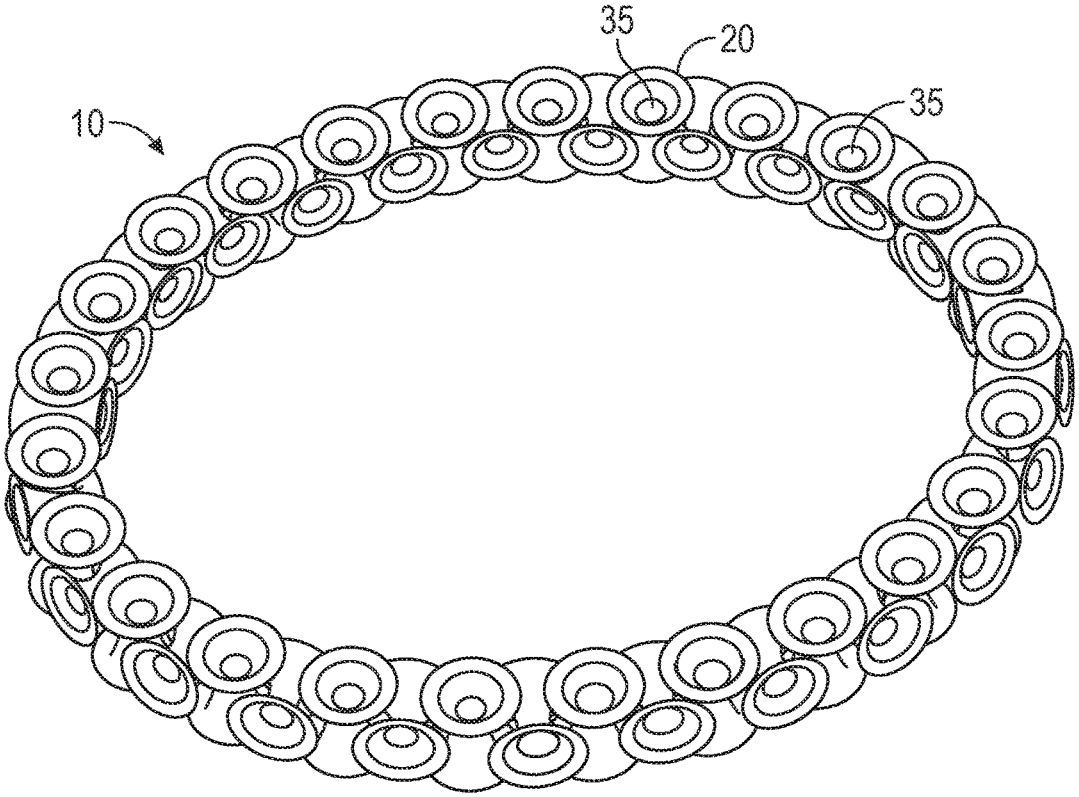
FIG. 4 illustrates a perspective view of a jewelry device in accordance with the various teachings of the present disclosure with ornamental stones removed to show the interior of the pods.
Figure 5:
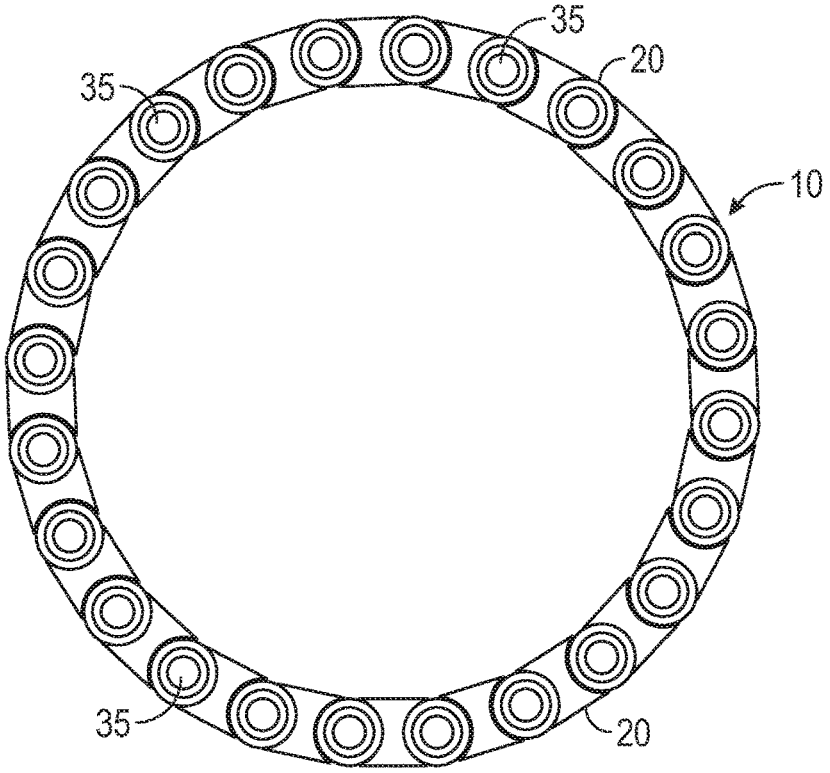
FIG. 5 illustrates a top view of the jewelry device shown in FIG. 4.
Figure 6:
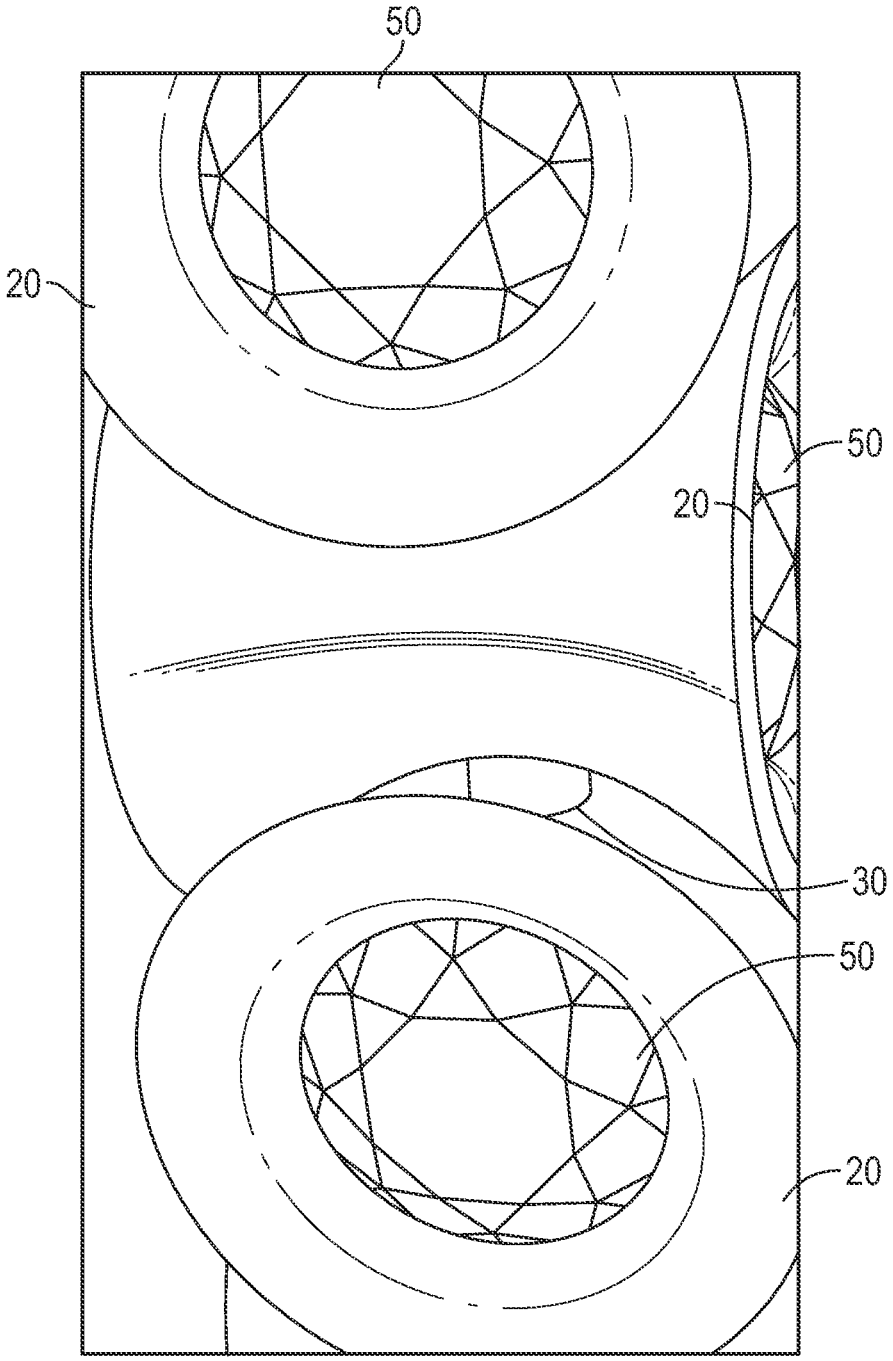
FIG. 6 illustrates an enlarged view of the jewelry device shown in FIG. 2.

In the following description of various illustrative embodiments, reference is made to the accompanying drawings, which form a part hereof, and in which is shown, by way of illustration, various embodiments in which aspects of the disclosure may be practiced. It is to be understood that other embodiments may be utilized, and structural and functional modifications may be made, without departing from the scope of the present disclosure.

As illustrated in FIGS. 1-14, in accordance with various constructions, a jewelry device or article of chain jewelry in the form of a bracelet 10 adapted to be worn around a portion of a human body, such as being suitable for wearing around a wrist of a wearer. In other constructions, the bracelet 10 can be provided in the form of an ornamental band, hoop, or chain worn on the wrist or arm or the desirable body part. For example, the bracelet 10 could be adapted to be worn around other parts of a wearer's anatomy, including the legs, neck, or head. In one embodiment, the bracelet 10 is generally provided in form of an interlocking chain of pods 20. In another embodiment, bracelet 20 is generally a chain of interlocking alternative stacked pods 20 configured to provide a dual axis view of ornamental stones 50 mounted at opposing ends of the pods. And when each pod 20 interlocks with the next pod, they do so by each pod being alternatively stacked horizontally, vertically, then horizontally, and so forth. Each pod 20 generally connects in interlocking configuration. The ornamental stones 50 can be diamonds, gemstones, semi-precious or precious gemstones, such as sapphire, topaz, emerald, ruby, and the like or synthetic stones.

In one construction, the shape of each pod 20 is not limited to the shape/form as long as each pod 20 is of the same form and symmetry. In this way, the shape of pod 20 can be a square form, octagonal form (for example see FIGS. 12-14), to create the alternative stacked configuration of the pods 20 to provide a dual axis view of ornamental stones 50 mounted therein. Each pod 20 generally has the same proportional measurements to enable support of other adjacent pods 20 thereof.

In one alternative construction, one or more pods 20 are designed to be hollowed or tubular such that as sidewalls are closed and opposing ends 24, 26 are opened to receive or mount ornamental stones 50 therein. The pods 20 serve as a double sided bezel to set the stones 50 therein. This configuration enables each pod 20 to hold a diamond/gemstone from both opposing ends 24, 26 and enable light to pass through the light transmissive gemstones including synthetic stones. This configuration creates light-tube feature or light tunnel 35 within the interior of the pod 20 to provide a visual striking appearance of gemstones on both ends of the pod 20 to enhance the brilliance of the stones 50. Design and form permits light to refract and to be captured within the space between the stones 50, thereby creating more brilliance of the diamonds & gemstones 50.

Figure 7:
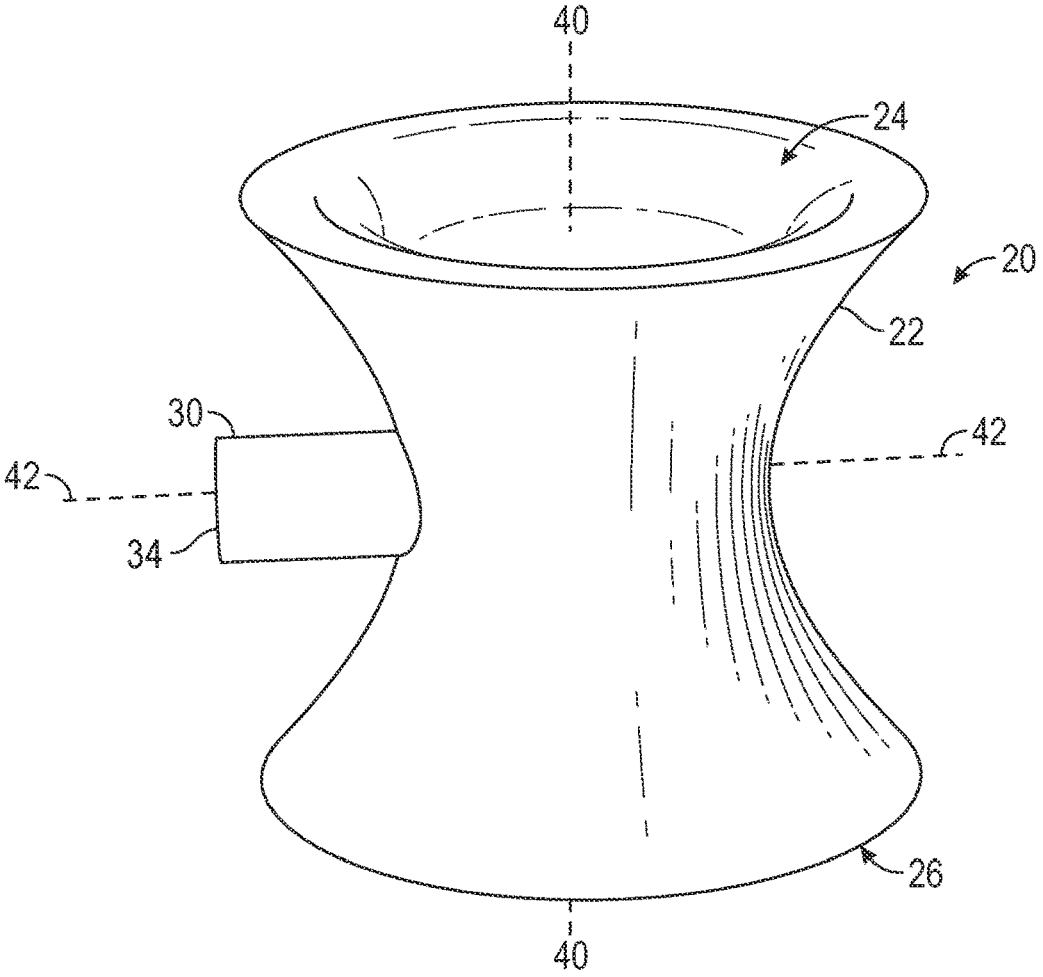
FIG. 7 illustrates a single pod configuration in accordance with the various teachings of the present disclosure.
Figure 8:
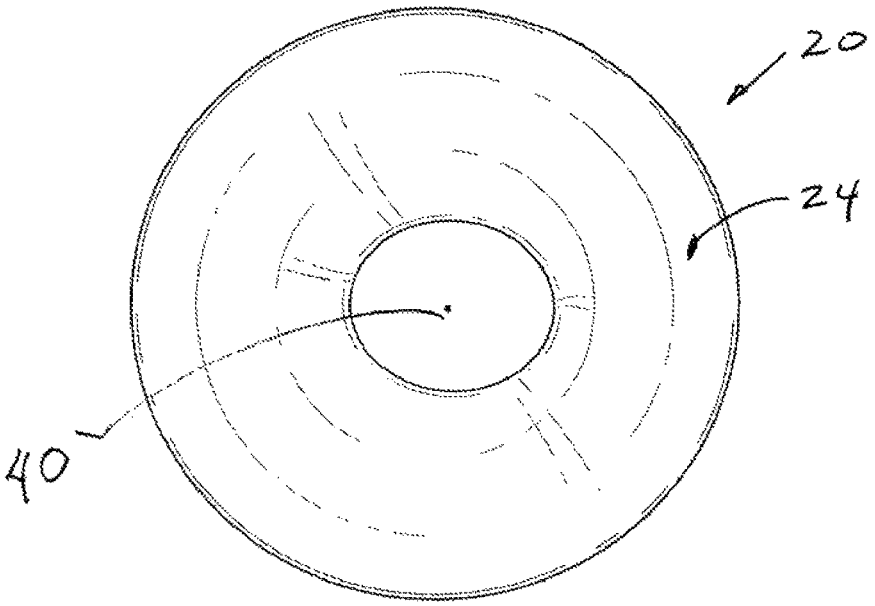
FIG. 8 illustrates a top view of the pod configuration shown in FIG. 7.
Figure 9:
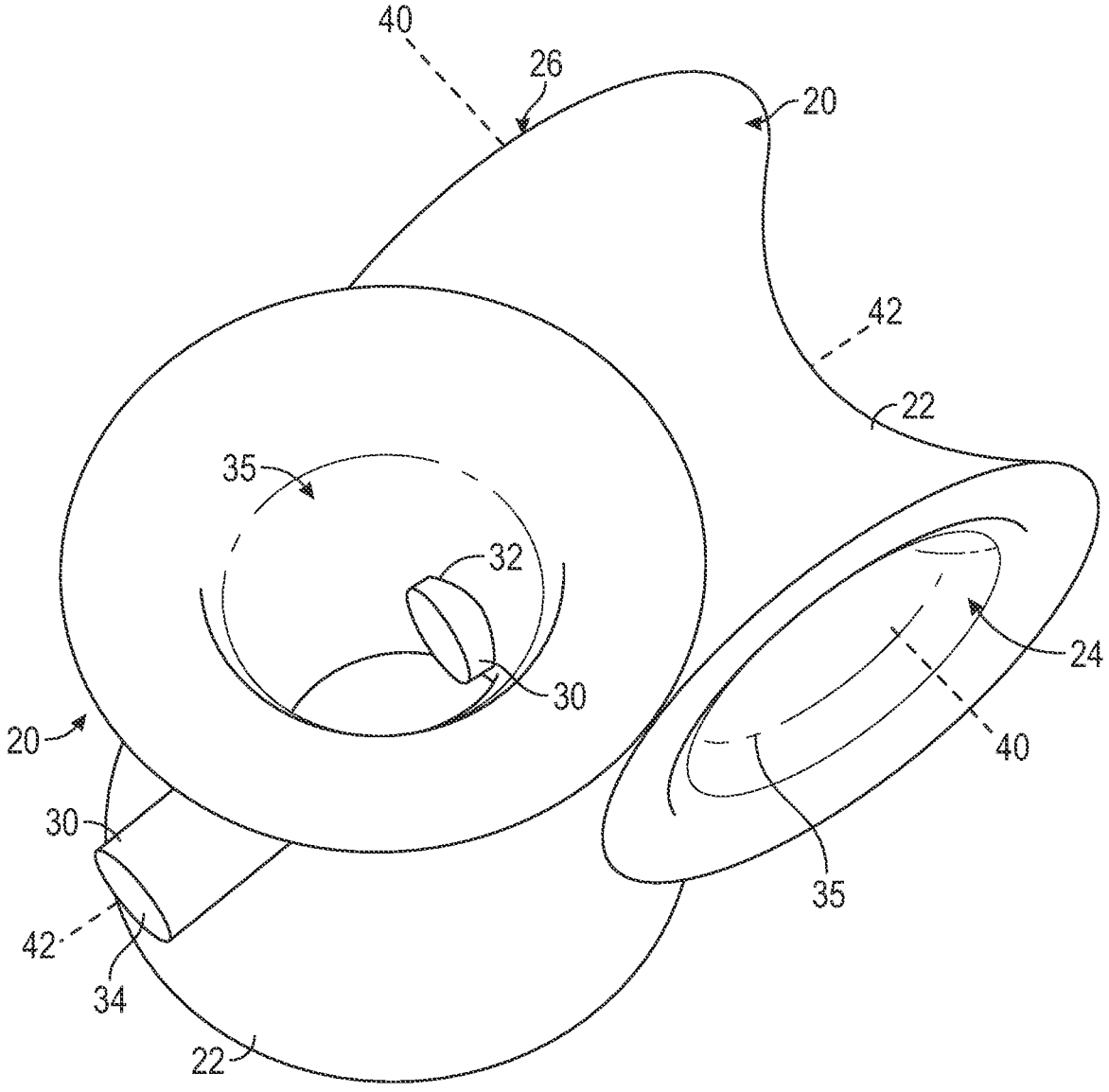
FIGS. 9 and 10 shows perspective views of a pod arrangement in accordance with the various teachings of the present disclosure.

Turning to FIGS. 7-14, in one construction, each pod 20, 120, 1320, 1420 is comprised of a body 22 with a first opening 24 and an opposing second opening 26. In alternative constructions, the body 22 can have different profile shapes, such as square 1320, 1420, or octagonal 120 (See FIGS. 12-14). Referring to FIGS. 7-9 for ease of explanation, each pod 20 has a longitudinal axis 40 extending through centerline of body 22. Additionally, each pod 20 has a transverse axis 20 to the longitudinal axis 40. The transverse axis 42 is disposed perpendicular to the longitudinal axis 40.

Figure 10:
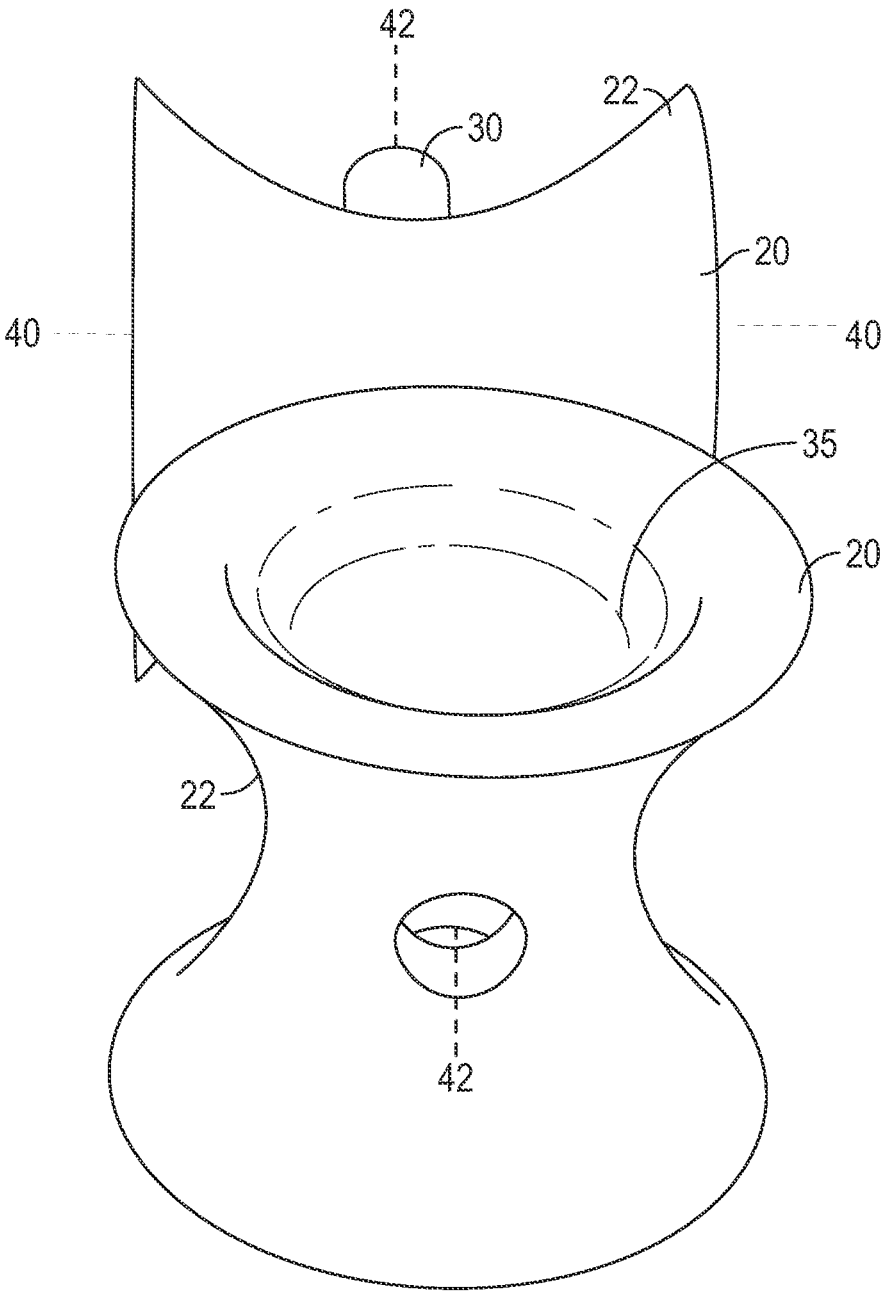
Figure 11:
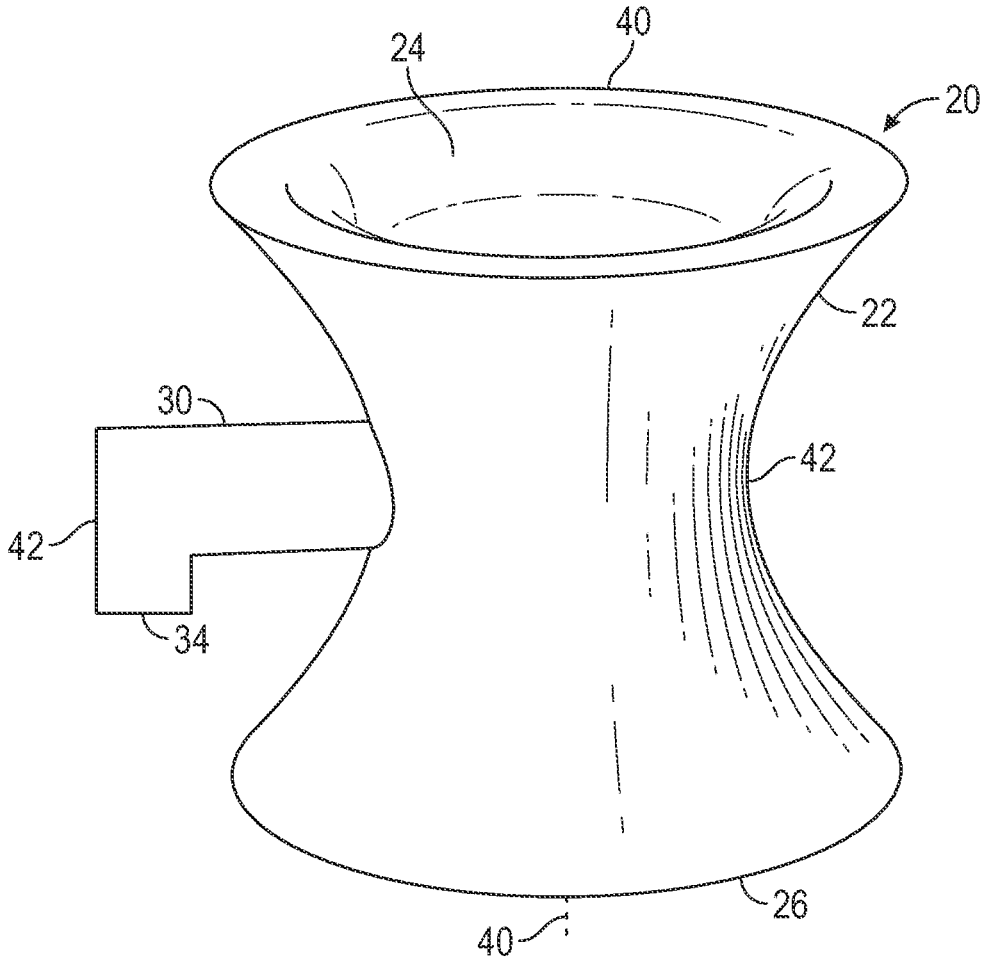
FIG. 11 illustrates a single pod configuration in accordance with the various teachings of the present disclosure with the peg in a bent arrangement for interlocking adjacent pods.

Referring to FIGS. 9-11, to provide the mechanical connection between each pod 20 of bracelet 10, each pod 20 may be configured with a male-female connection. In one construction, a straight peg 30 may extend from one side of the body 22 into a receiver 32 cavity of a complementary shape. The peg 30 may have numerous cross-sectional shapes. In the construction shown in FIGS. 9-11, the peg 30 has a circular cross-section such that the peg 30 resembles a cylinder extending from the body 22 of pod 20. The receiver cavity 32 has circular profile to match the cross-sectional profile shape of the peg 30. The peg 30 and receiver cavity 32 can be disposed along the transverse axis 42 such that the axis 42 is the center of peg 30 and receiver cavity 32. During manufacturing of bracelet 10, the free end 34 of peg 30 can be bent into an L-shape arrangement, as seen in FIG. 11, to create the mechanical connection as the bent portion engages the interior cavity wall. The cylindrical peg 30 within the receiver cavity 32 allows for free rotation of the pods 20 relative to each other.

The pods 20 can be of a molded construction of numerous materials, such as precious and semi-precious metals. Some example of materials can be gold, silver, platinum, or a blend of various metals or other materials.

Figure 12:
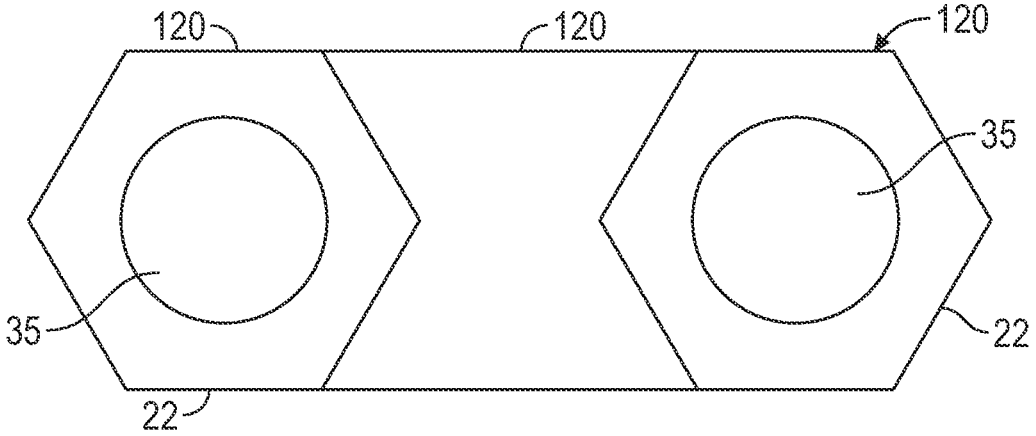
FIG. 12 illustrates an enlarged top view of one alternative profile construction of a portion of a jewelry device in accordance with the various teachings of the present disclosure.
Figure 14:
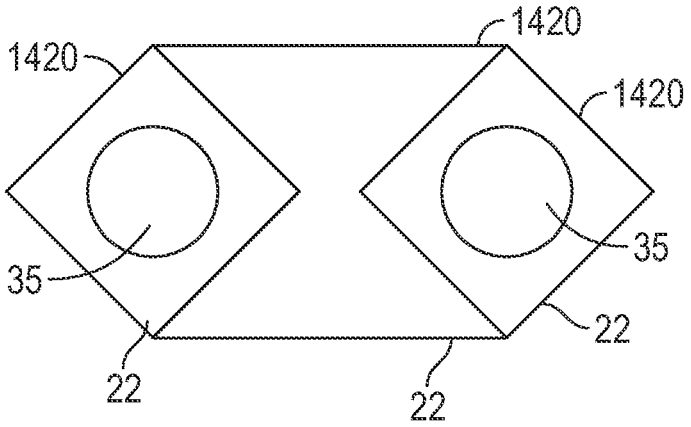
FIG. 14 illustrates an enlarged top view of yet another alternative profile construction of a portion of a jewelry device in accordance with the various teachings of the present disclosure.

A pod unit 20 may be designed in the form of a pinched or waist profile configuration, such as the interior center portion has a smaller diameter than the opposing ends 24-26 of the pod body 22 (see FIGS. 7, 12, 14). The pod unit 20 can be in a hollowed out arrangement and having an approximate 1 mm wall thickness. Nevertheless, other wall thickness of the pod unit are possible such as 1.1 mm, 1.2 mm, 1.3 mm to 1.5 mm, for example. The body of the pod unit 20 may have one peg 30 extending therefrom which engages a hole 32 sized slightly larger than size of the peg 30 on the opposing side of the body. In operation, when the pod units 20 connected and stacked together, the peg 30 of adjacent pod units connects into the hole 32. Thus, enabling longitudinal and rotatable movement of each pod unit 20 with respect to each other to provide movement about the body portion of the wearer of device 10.

A bezel set is a type of stone setting, with a rim enclosing the belly of the stone. The arrangement of each pod 20 unit provides to be able to see a stone 50 set from every direction. The hollowed out area 35 (light-tube) creates a double sided bezel of the pod 20, thus allowing light to pass through and thereby giving the stone an enhanced three-dimensional striking appearance for brilliance. In this way, natural light or artificial light can pass through the stone 50 from both directions of opposing ends 24, 26. It should be noted that system may work with one stone in one end 24 and no stone in the other end or reversed. Nevertheless, it is preferred to have light transmissive stones 50 in both ends. Additionally, due to the nature of light refracting tunnel 35 provide light though the pod 20, the device 10 can be used without stones 50.

Figure 13:
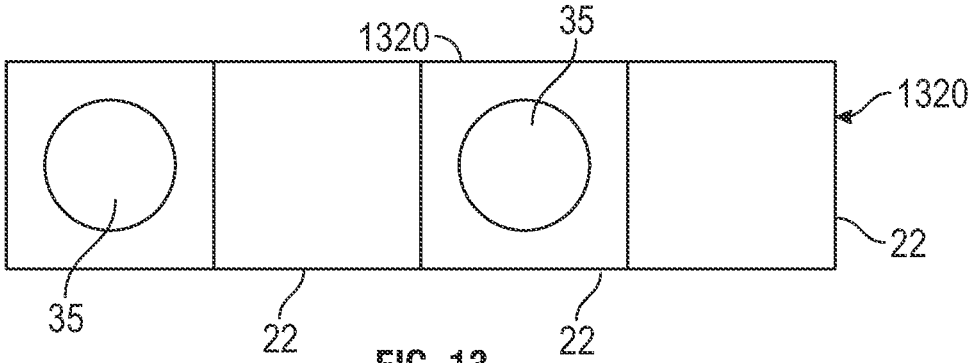
FIG. 13 illustrates an enlarged top view of another alternative profile construction of a portion of a jewelry device in accordance with the various teachings of the present disclosure.

Generally, the shape of each unit is not as relevant as the utility of how they function. The utility is not limited to the shape/form (in this case, pinched design) as long as each unit is of generally the same form and symmetry within small manufacturing tolerances in dimension. The pod 20 design can be a square form, to create this concept, as shown in FIGS. 13 and 14. Generally, each pod unit 20 has been designed to have same/equal measurement to enable support of other units. For every unit is designed to be hollowed out, and to serve as a double sided bezel; enabling each unit to hold a diamond/gemstone from both ends. And when each unit interlocks with the next, they do so forming horizontally, vertically, horizontally, etc.

Numerous other embodiments, modifications, and variations within the scope and spirit of the appended claims will occur to persons of ordinary skill in the art from a review of this disclosure. For example, one or more of the steps depicted in the illustrative figures may be performed in other than the recited order, and one or more depicted steps may be optional in accordance with aspects of the disclosure.

What is claimed is:

1. An article of chain jewelry adapted to be worn around a portion of a human body, comprising:

a plurality of interlocking pods provided in an opposing-stacked arrangement in which the pods have a longitudinal axis;

wherein at least one pod includes a substantially enclosed light tunnel having opaque sidewalls extending between opposing ends of the light tunnel, the light tunnel being generally disposed along the longitudinal axis of the at least one pod and the opposing ends of the light tunnel are configured to receive an object therein.

2. The article of jewelry according to claim 1, wherein each of the pods has a body including a receiver opening into a substantially enclosed light tunnel having opaque sidewalls extending between opposing ends of the light tunnel and an opposing slender protrusion extending from the body; wherein the receiver opening and the slender protrusion being disposed along a common body axis and the body axis being transverse to the longitudinal axis of the pod.

3. The article of jewelry according to claim 2, wherein the slender protrusion of an adjacent pod matingly interlocks within the receiver opening of the adjacent pod.

4. The article of jewelry according to claim 3, wherein the slender protrusion comprises an L-shape to provide an interlocking function of the adjacent pods.

5. The article of jewelry according to claim 2, wherein the interlocked pods are enabled to move with respect to each along an axis created by the slender protrusion.

6. The article of jewelry bracelet according to claim 5, wherein the slender protrusion comprises a cylinder.

7. The article of jewelry according to claim 6, wherein the cylinder is provided in a L-shape configuration.

8. The article of jewelry according to claim 1, wherein the opposing ends of each pod includes a bezel setting for mounting the object therein.

9. The article of jewelry according to claim 8, wherein the object comprises an ornamental stone.

10. The article of jewelry according to claim 9, wherein the ornamental stone is light transmissive.

11. The article of jewelry according to claim 8, wherein each of pods has a body including a receiver opening into a substantially enclosed light tunnel having opaque sidewalls extending between opposing ends of the light tunnel, and an opposing slender protrusion extending from the body; wherein the receiver opening and the slender protrusion being disposed along a common body axis and the body axis being transverse to the longitudinal axis of the pod.

12. The article of jewelry according to claim 11, wherein the body of each pod comprises an waist-shape configuration.

13. An article of chain jewelry adapted to be worn around a portion of a human body, comprising: a plurality of interlocking double bezel pods provided in an opposing-stacked arrangement in which the pods have a longitudinal axis; wherein at least one of the pods includes a substantially enclosed light-tube generally disposed along the longitudinal axis connecting the opposing bezels of the pod and the light-tube includes opaque sidewalls.

14. The article of jewelry according to claim 13, wherein each of pods has a body including an opening into a substantially enclosed light-tube having opaque sidewalls and an opposing slender protrusion extending from the body; wherein the opening and the slender protrusion being disposed along a common body axis and the body axis being transverse to the longitudinal axis of the pod.

15. The article of jewelry according to claim 14, wherein the slender protrusion of an adjacent pod matingly interlocks within the opening of the adjacent pod.

16. The article of jewelry according to claim 15, wherein the slender protrusion comprises an L-shape to provide an interlocking function of the adjacent pods.

17. The article of jewelry according to claim 14, wherein the interlocked double bezel pods are enabled to move with respect to each other along the common body axis.

18. The article of jewelry according to claim 13, wherein the bezels of the pods are configured to receive a light transmissive object therein.

19. An article of chain jewelry adapted to be worn around a portion of a human body, comprising: a plurality of interlocking pods provided in an opposing-stacked arrangement in which the pods have a longitudinal axis and opposing bezels at distal ends; wherein at least one of the pods includes a substantially enclosed light-tunnel generally disposed along the longitudinal axis connecting the opposing bezels of the pod, and the light-tunnel includes opaque sidewalls.

20. The article of jewelry according to claim 19, wherein each of pods has a body including an opening into a substantially enclosed light-tunnel having opaque sidewalls and an opposing slender protrusion extending from the body; wherein the opening and the slender protrusion being disposed along a common body axis and the body axis being transverse to the longitudinal axis of the pod; wherein the pods are enabled to move with respect to each other along the slender protrusion.

* * * * *